US010027046B1

(12) United States Patent
Phillips et al.

(10) Patent No.: US 10,027,046 B1
(45) Date of Patent: Jul. 17, 2018

(54) RECEPTACLE CONNECTOR WITH STUB-LESS CONTACTS

(71) Applicant: TE CONNECTIVITY CORPORATION, Berwyn, PA (US)

(72) Inventors: Michael John Phillips, Camp Hill, PA (US); Randall Robert Henry, Harrisburg, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 15/602,541

(22) Filed: May 23, 2017

(51) Int. Cl.
*H01R 12/72* (2011.01)
*H01R 13/24* (2006.01)
*H01R 13/42* (2006.01)

(52) U.S. Cl.
CPC ..... *H01R 12/721* (2013.01); *H01R 13/2407* (2013.01); *H01R 13/42* (2013.01)

(58) Field of Classification Search
CPC ... H01R 12/721; H01R 13/2407; H01R 13/42
USPC ..... 439/637
See application file for complete search history.

(56) References Cited

U.S. PATENT DOCUMENTS 3,601,775 A * 8/1971 Longenecker ..... H01R 12/721 439/636
4,332,431 A * 6/1982 Bobb ..... H01R 12/88 439/267
4,503,609 A * 3/1985 Mackay ..... H01L 21/4853 29/843
4,557,548 A * 12/1985 Thrush ..... H01R 12/716 439/842
4,734,041 A * 3/1988 Bruchmann ..... H01R 12/82 439/637
4,734,060 A * 3/1988 Kawawada ..... H01R 13/28 439/295
4,756,694 A * 7/1988 Billman ..... H01R 12/721 439/328
4,955,820 A * 9/1990 Yamada ..... H01R 4/02 439/83
5,433,616 A * 7/1995 Walden ..... H01R 12/721 439/62
5,476,389 A * 12/1995 Ono ..... H01R 12/57 439/637
5,931,705 A * 8/1999 Young ..... H01R 12/57 439/682
6,106,305 A * 8/2000 Kozel ..... H01R 12/7082 439/66
6,914,189 B1 * 7/2005 Ling ..... H05K 5/0265 174/541
7,014,487 B2 * 3/2006 Ishikawa ..... H01R 13/055 439/267

(Continued)

*Primary Examiner* — Alexander Gilman

(57) ABSTRACT

A receptacle connector includes a housing and a plurality of contacts held in the housing. The housing extends between a front end and an opposite, rear end. The housing defines a card slot that is open at the front end for receiving a mating plug connector into the card slot through the front end. The contacts include deflectable spring beams exposed in the card slot and configured for electrical connection with the plug connector. Each of the spring beams extends continuously from an arm to a distal tip. The spring beams include bends between the arms and the distal tips. The bends are located at front ends of the contacts such that the distal tips and the arms of the spring beams are disposed rearward of the bends.

20 Claims, 5 Drawing Sheets

(56) References Cited

U.S. PATENT DOCUMENTS

| | | | | |
|---|---|---|---|---|
| 7,104,807 | B1 * | 9/2006 | Wang | H01R 12/57<br>361/737 |
| 7,563,104 | B2 * | 7/2009 | Kim | H01R 12/58<br>439/66 |

* cited by examiner

RECEPTACLE CONNECTOR WITH STUB-LESS CONTACTS

BACKGROUND OF THE INVENTION

The subject matter herein relates generally to receptacle connectors having stub-less contacts.

High speed electrical connectors typically transmit and receive data signals across a mating interface. For example, some known receptacle connectors are mounted to a circuit board and include a card slot that receives a card edge of a plug connector at the mating interface. The receptacle connectors have contacts with deflectable spring beams at the mating interface that are spring loaded against the plug connector when the plug connector is loaded into the slot.

However, known receptacle connectors are not without disadvantages. For example, the spring beams in some known receptacle connectors include lead-in portions that extend from a contact location, which is the area of the spring beam that engages the plug connector, to a distal tip or end of the spring beam. The lead-in portions guide the plug connector into proper alignment with the contact locations of the spring beams as the plug connector is loaded into the card slot. The intended electrical current path extends from the contact location rearward along the length of the contact to a termination end of the contact. The lead-in portion of the spring beam is in front of the contact location, and therefore outside of the intended current path. The lead-in portion forms an antenna-like hanging conductive feature, or stub segment, which can reduce signal transmission performance of the high speed electrical connectors. For example, the stub segment can increase signal loss by acting as an antenna that discharges electrical energy from the connectors. In addition, the stub segment can negatively affect the impedance at the mating interface, which increases electrical resistance at the mating interface. Furthermore, the stub segment can provide a pathway for electrical resonance to reflect back and forth along the lengths of the contacts, causing a standing wave that degrades the signal transmission performance.

A need remains for a receptacle connector that has contacts that provide lead-in to a plug connector without forming antenna-like stub segments that can degrade the signal transmission performance.

BRIEF DESCRIPTION OF THE INVENTION

In an embodiment, a receptacle connector is provided that includes a housing and a plurality of contacts held in the housing. The housing extends between a front end and an opposite, rear end. The housing defines a card slot that is open at the front end for receiving a mating plug connector into the card slot through the front end. The contacts include deflectable spring beams exposed in the card slot and configured for electrical connection with the plug connector. Each of the spring beams extends continuously from an arm to a distal tip. The spring beams include bends between the arms and the distal tips. The bends are located at front ends of the contacts such that the distal tips and the arms of the spring beams are disposed rearward of the bends.

In an embodiment, a receptacle connector is provided that includes a housing and a plurality of contacts held in the housing. The housing extends between a front end and an opposite, rear end. The housing has first and second side walls extending to the front end. The housing defines a card slot that is open at the front end for receiving a mating plug connector into the card slot through the front end. The first and second side walls include interior surfaces that define the card slot therebetween. The card slot has a center line centered between the interior surfaces. The contacts are arranged in first and second contact arrays along the first and second side walls, respectively. The contacts include deflectable spring beams exposed in the card slot and configured for electrical connection with the plug connector. Each of the spring beams extends continuously from an arm to a distal tip. The spring beams include bends between the arms and the distal tips. The bends of the spring beams extend from the arms towards the center line of the card slot such that the distal tips are disposed more proximate to the center line than a proximity of the arms to the center line.

In an embodiment, a receptacle connector is provided that includes a housing and a plurality of contacts held in the housing. The housing extends between a front end and an opposite, rear end. The housing defines a card slot that is open at the front end for receiving a mating plug connector into the card slot through the front end. The contacts include deflectable spring beams exposed in the card slot and configured for electrical connection with the plug connector. Each of the spring beams includes an arm extending frontward to a bend at a front end of the spring beam. The spring beams further include lead-in segments extending from the bends to distal tips. The lead-in segments extend rearward and into an interior of the card slot to prevent stubbing with the plug connector when the plug connector is loaded into the card slot in a rearward loading direction.

DETAILED DESCRIPTION OF THE INVENTION

Figure 1:
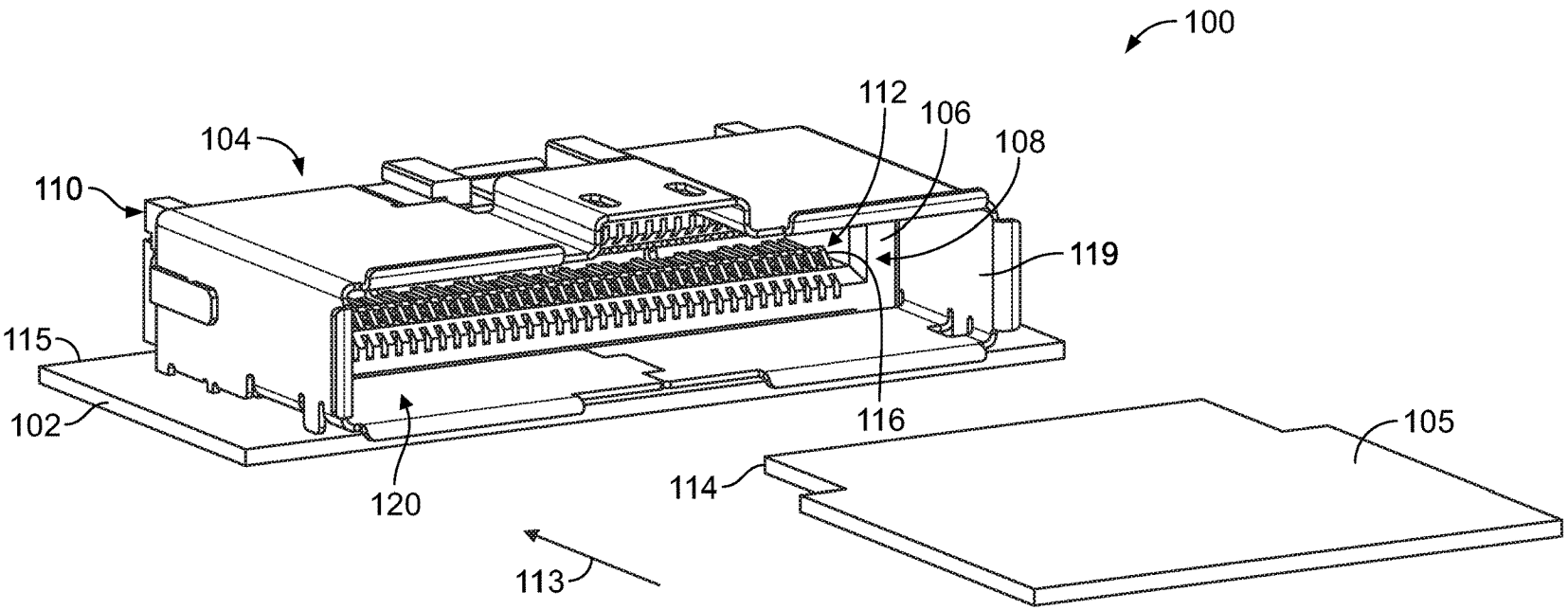
FIG. 1 is a front perspective view of an electrical connector system according to an exemplary embodiment showing components in an unmated state and poised for mating.

FIG. 1 is a front perspective view of an electrical connector system 100 according to an exemplary embodiment showing components in an unmated state and poised for mating. The electrical connector system 100 includes a circuit board 102 and a receptacle connector 104 mounted to the circuit board 102. The receptacle connector 104 is configured to electrically connect to a plug connector 105 in order to provide an electrically conductive signal path between the circuit board 102 and the plug connector 105. The receptacle connector 104 may be a high speed connector that transmits data signals at speeds over 10 gigabits per second (Gbps), such as over 25 Gbps. The receptacle connector 104 may also be configured to transmit low speed data signals and/or power. The receptacle connector optionally may be an input-output (I/O) connector.

The receptacle connector 104 includes a housing 106 extending between a front end 108 and an opposite, rear end 110. As used herein, relative or spatial terms such as "front," "rear," "first," "second," "top," "bottom," "left," and "right" are only used to distinguish the referenced elements of the receptacle connector 104 and do not necessarily require particular positions or orientations relative to gravity and/or relative to the surrounding environment of the connector system 100. The front end 108 defines an interface for connecting to the plug connector 105. In the illustrated embodiment, the front end 108 defines a socket or card slot 112 that is configured to receive the plug connector 105 therein.

In the illustrated embodiment, a card edge 114 of the plug connector 105 defines a mating end of the plug connector 105. The card edge 114 may be an edge of a circuit card of the plug connector 105 having exposed conductors on one or both sides thereof that are configured to be plugged into the card slot 112. In other various embodiments, the card edge 114 may be an edge of a plug housing having exposed conductors on one or both sides thereof configured to be plugged into the slot 112, or the card edge 114 may be another pluggable structure configured to be received in the slot 112 for electrical connection with the receptacle connector 104.

The receptacle connector 104, in the illustrated embodiment, is a right angle style connector that is configured to receive the plug connector 105 in a loading direction 113 that is parallel to a top surface 115 of the circuit board 102. The loading direction 113 is a rearward loading direction such that the card edge 114 of the plug connector 105 enters the card slot 112 through an opening defined at the front end 108 of the housing 106 and moves towards the rear end 110 until reaching a fully mated position. The housing 106 includes a bottom side 117 (shown in FIG. 2) that is mounted to the top surface 115 of the circuit board 102. For example, the bottom side 117 abuts or at least faces the top surface 115. In an alternative embodiment, the receptacle connector 104 may be a vertical board-mount connector such that the rear end 110 of the housing 106 is configured to mount to the circuit board 102, and the card slot 112 is configured to receive the plug connector 105 in a loading direction that is transverse to, such as perpendicular to, the top surface 115 of the circuit board 102. In another alternative embodiment, the receptacle connector 104 may be terminated to an electrical cable instead of to the circuit board 102. Optionally, the plug connector 105 may be a transceiver style connector that is configured to be terminated to one or more cables (not shown).

The housing 106 of the receptacle connector 104 holds a plurality of contacts 116 at least partially within the housing 106. The contacts 116 are configured to provide conductive signal paths through the receptacle connector 104. The contacts 116 are exposed within the card slot 112 for engaging and electrically connecting to corresponding conductors (for example, traces or mating contacts) of the plug connector 105 within the card slot 112 when the plug connector 105 is fully mated to the receptacle connector 104. Each of the exposed portions of the contacts 116 within the card slot 112 engages the corresponding mating conductor at a separable mating interface.

The receptacle connector 104 optionally includes a shroud 119 that at least partially surrounds the housing 106. The shroud 119 extends forward beyond the front end 108 of the housing 106, and defines a compartment 120 into which the plug connector 105 enters prior to entering the card slot 112 during a mating operation. The shroud 119 may be composed of an electrically conductive material, such as one or more metals, in order to provide electrical shielding surrounding the mating interface between the connectors 104, 105.

Figure 2:
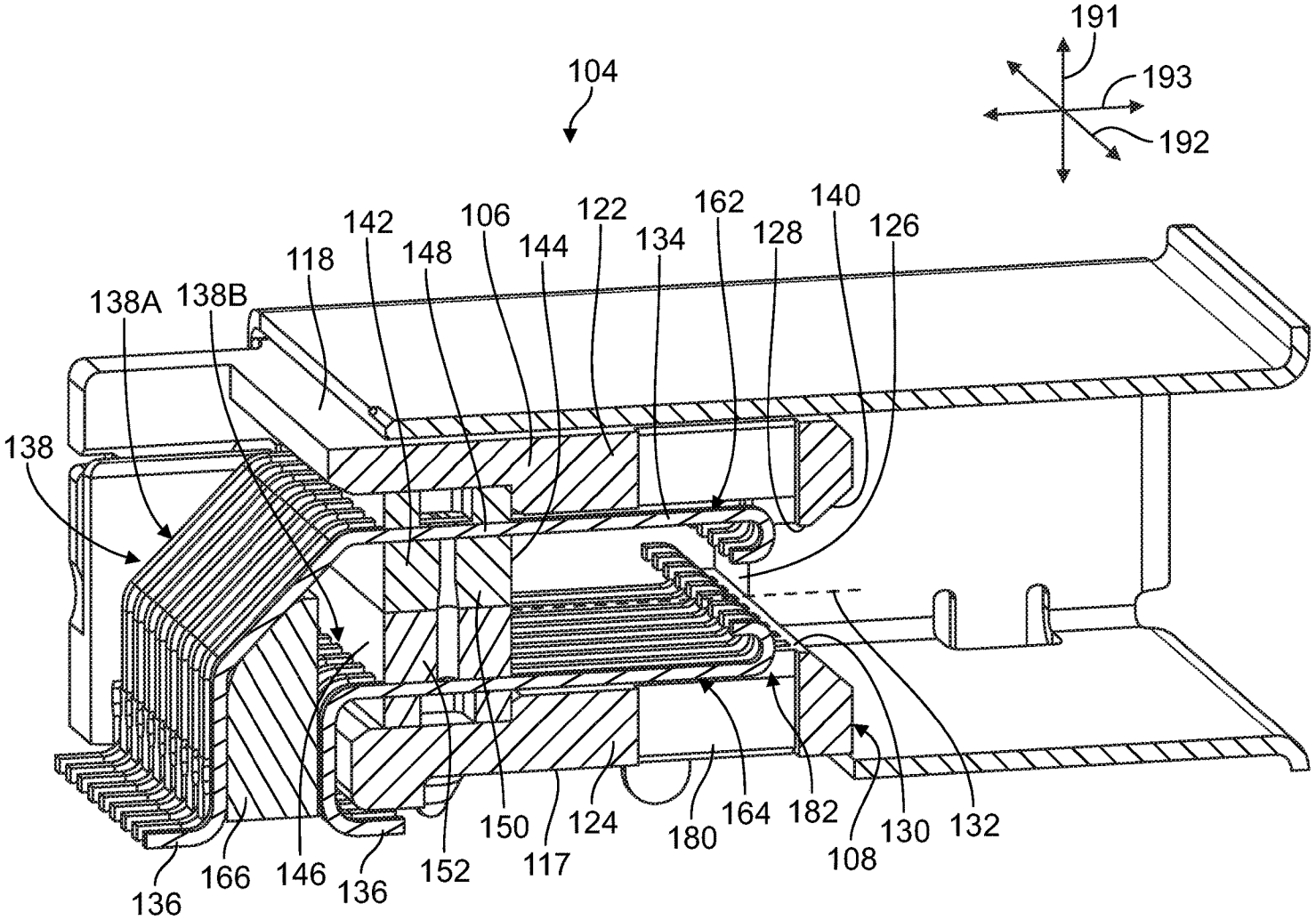
FIG. 2 is a side cross-sectional view of a receptacle connector of the connector system according to an embodiment.

FIG. 2 is a side cross-sectional view of the receptacle connector 104 according to an embodiment. The circuit board 102 is not shown in FIG. 2. The receptacle connector 104 is oriented with respect to a vertical or elevation axis 191, a lateral axis 192, and a longitudinal axis 193. The axes 191-193 are mutually perpendicular. Although the elevation axis 191 appears to extend in a vertical direction generally parallel to gravity, it is understood that the axes 191-193 are not required to have any particular orientation with respect to gravity.

The housing 106 includes the bottom side 117 and an opposite, top side 118. The housing 106 includes a first side wall 122 and a second side wall 124 that each extends to the front end 108 of the housing 106. The first side wall 122 may define the top side 118, and the second side wall 124 may define the bottom side 117. The housing 106 optionally includes a first end wall 126 and a second end wall (not shown) that each extends between the side walls 122, 124. The card slot 112 is defined between the side walls 122, 124 and the end walls 126. For example, a vertical height of the card slot 112 is defined between interior surfaces 128, 130 of the first and second side walls 122, 124, respectively. The interior surfaces 128, 130 oppose each other on opposite sides of the card slot 112. The card slot 112 has a center line 132 that is centered between the interior surfaces 128, 130. The center line 132 extends along the longitudinal axis 193 and is vertically equidistant from the interior surfaces 128, 130. Optionally, the housing 106 includes chamfered surfaces 140 at the front end 108 that provide a lead-in for guiding the plug connector 105 into the card slot 112. The chamfered surfaces 140 may be provided on the side walls 122, 124 and/or the end walls 126. The housing 106 is composed of a dielectric material, such as a plastic or one or more other polymers.

The electrical contacts 116 of the receptacle connector 104 each includes a deflectable spring beam 134 that is exposed within the card slot 112 and configured to engage and electrically connect to the plug connector 105 (shown in FIG. 1) when the plug connector 105 is received in the card slot 112. The spring beams 134 define mating segments of the contacts 116. The contacts 116 extend continuously from the spring beams 134 to respective terminating ends 136. The terminating ends 136 are configured to be terminated to corresponding contact elements (not shown) of the circuit board 102 via thru-hole mounting to conductive vias, surface-mounting to conductive pads, and/or the like. For example, the terminating ends 136 of the contacts 116 in the illustrated embodiment are tails configured to be surface-mounted to pads on the circuit board 102 via soldering, fasteners, or the like.

In an embodiment, the contacts 116 are organized in at least one contact array 138. The contacts 116 in a respective array 138 are arranged side-by-side in a row. Adjacent contacts 116 in the same array 138 may extend parallel to each other. In the illustrated embodiment, the contacts 116 are organized in two arrays 138. The spring beams 134 of the contacts 116 in a first array 138A of the two arrays 138 extend at least partially into the card slot 112 from the first side wall 122, and the spring beams 134 of the contacts 116 of a second array 138B of the two arrays 138 extend at least partially into the card slot 112 from the second side wall 124. Thus, the spring beams 134 of the first array 138A of contacts 116 are configured to engage one side of the card edge 114 (shown in FIG. 1) of the plug connector 105 (FIG. 1), while the spring beams 134 of the second array 138B of contacts 116 are configured to engage the opposite side of the card edge 114. The spring beams 134 may be configured to deflect towards and/or into the respective side walls 122, 124 from which the spring beams 134 extend in order to exert a biased retention force on the plug connector 105 to retain mechanical and electrical contact with the corresponding mating conductors. The card edge 114 of the plug connector 105 may be generally centered vertically within the card slot 112 to balance the mating forces of the contacts 116.

The contacts 116 are composed of an electrically conductive material, such as one or more metals. The contacts 116 may be individually stamped into shape from a flat sheet of metal. Alternatively, the contacts 116 of each array 138 may be formed into shape collectively, and then cut apart from one another to define the individual contacts 116. In an embodiment, some of the contacts 116 of the receptacle connector 104 are used to convey high speed data signals and some other contacts 116 are used as ground conductors to provide electrical shielding for the high speed signals and ground paths through the receptacle connector 104. Optionally, some of the contacts 116 may be used to provide low speed data signals, power, or the like, instead of high speed data signals.

In an embodiment, the contacts 116 are held by a dielectric carrier 142 within the housing 106. The dielectric carrier 142 extends vertically between the first side wall 122 and the second side wall 124. The dielectric carrier 142 has a front 144 and a rear 146. The dielectric carrier 142 is located rearward of the card slot 112. For example, the front 144 of the dielectric carrier 142 may define a back or rear wall of the card slot 112. The contacts 116 extend through the dielectric carrier 142 such that the spring beams 134 protrude from the front 144 and the terminating ends 136 protrude from the rear 146. The dielectric carrier 142 engages and holds an intermediate section 148 of the contacts 116 to retain the relative positioning and orientations of the contacts 116. The dielectric carrier 142 is formed of a dielectric material, such as a plastic or one or more other polymers. The dielectric carrier 142 may be overmolded around the contacts 116. Alternatively, the contacts 116 may be loaded or stitched into the dielectric carrier 142. The dielectric carrier 142 may include securing features, such as posts, openings, clips, latches, protrusions, or the like, for interacting with corresponding securing features of the housing 106 to hold the dielectric carrier 142 in place relative to the housing 106.

In the illustrated embodiment, the dielectric carrier 142 has a two-piece construction defined by an upper carrier 150 and a lower carrier 152. The contacts 116 in the first array 138A are held by the upper carrier 150, and the contacts 116 in the second array 138B are held by the lower carrier 152. The upper carrier 150 is stacked on top of the lower carrier 152 within the housing 106. The upper carrier 150 may be secured to the lower carrier 152 via integral securing features (e.g., posts and mirroring apertures), fasteners, adhesives, or the like, to define the assembled dielectric carrier 142.

Figure 3:
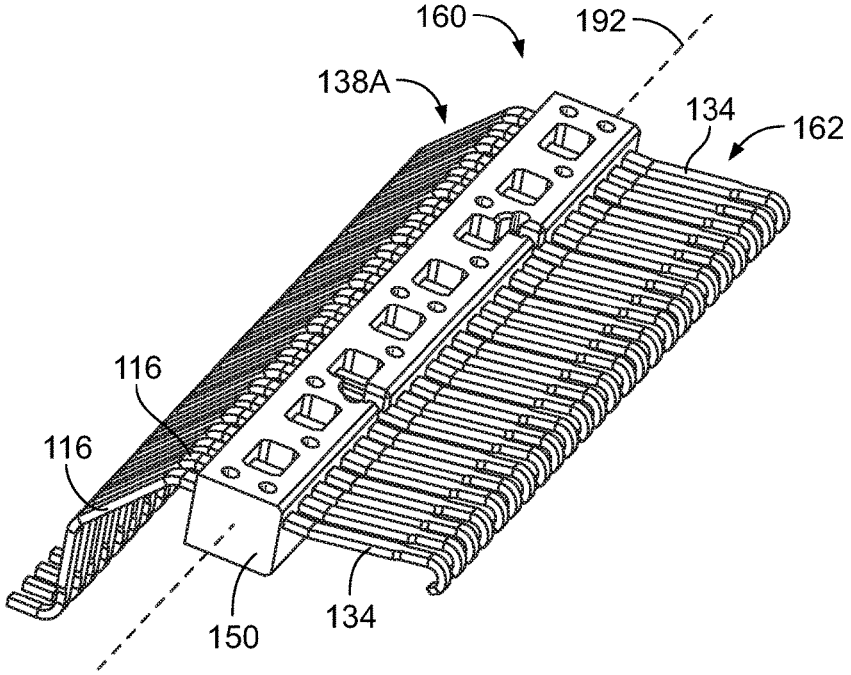
FIG. 3 is a perspective view of a contact sub-assembly of the receptacle connector according to an embodiment.

FIG. 3 is a perspective view of a contact sub-assembly 160 according to an embodiment. The contact sub-assembly 160 includes the upper carrier 150 and the electrical contacts 116 in the first array 138A. Although not shown in FIG. 3, the lower carrier 152 and the contacts 116 in the second array 138B define another contact sub-assembly that may be similar to the contact sub-assembly 160. The contact sub-assembly 160 may have any number of electrical contacts 116. The contacts 116 in the upper carrier 150 may be evenly spaced apart along the lateral axis 192, and held in position by the upper carrier 150. As shown in FIG. 3, the spring beams 134 of the contacts 116 in the first array 138A are arranged side-by-side in a first row 162. As shown in FIG. 2, the spring beams 134 of the contacts 116 in the second array 138B are also arranged side-by-side in a second row 164. The first and second rows 162, 164 may extend parallel to each other on opposite sides of the center line 132 of the card slot 112.

Referring now back to FIG. 2, in an alternative embodiment, the dielectric carrier 142 may have a unitary, one-piece construction such that the single dielectric carrier 142 holds both arrays 138A, 138B. In another alternative embodiment, the receptacle connector 104 only includes a single array 138 of contacts 116, instead of two arrays 138, such that the dielectric carrier 142 holds the single array 138. In yet another alternative embodiment, the receptacle connector 104 does not include the dielectric carrier 142, but rather a portion of the housing 106 holds the intermediate sections 148 of the electrical contacts 116 to retain the contacts 116 in place.

Optionally, the receptacle connector 104 includes a terminating end organizer 166 that engages the terminating ends 136 of the contacts 116 to control the positioning of the terminating ends 136 relative to one another. The organizer 166 is located between the terminating ends 136 of the first array 138A and the terminating ends 136 of the second array 138B, and may provide some electrical insulation and/or shielding between the two arrays 138A, 138B.

Figure 4:
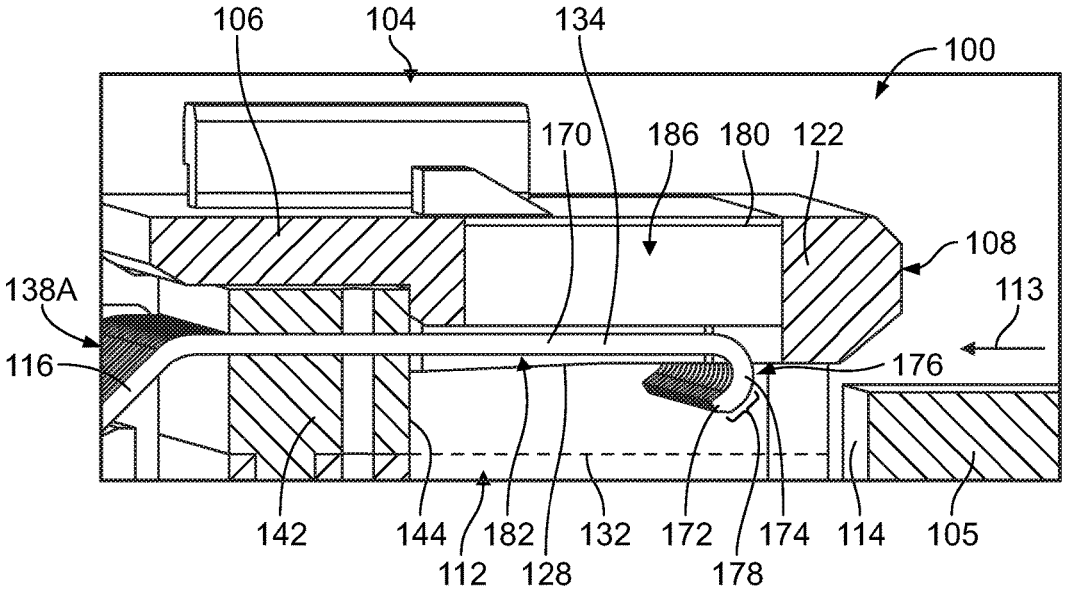
FIG. 4 is a close-up cross-sectional portion of the electrical connector system according to an embodiment showing a plug connector poised for loading into a card slot of the receptacle connector.

FIG. 4 is a close-up cross-sectional portion of the electrical connector system 100 according to an embodiment showing the plug connector 105 poised for loading into the card slot 112 of the receptacle connector 104. The illustrated portion of the receptacle connector 104 includes the first side wall 122 of the housing 106 and the spring beams 134 of the first array 138A of contacts 116. In an embodiment, the spring beams 134 of the different contacts 116 in the first array 138A have identical shapes and sizes as one another (except for possible manufacturing inconsistencies), such that the following description of one spring beam 134 also applies to the other spring beams 134 in the first array 138A. Furthermore, the spring beams 134 of the second array 138B of contacts 116 (shown in FIG. 2) may be mirror images of the spring beams 134 of the first array 138B across the center line 132, such that the following description also applies to the spring beams 134 of the second array 138B.

The spring beam 134 protrudes from the dielectric carrier 142 and extends continuously along the length of the contact 116 from a deflectable arm 170 to a distal tip 172. The distal tip 172 defines the distal end of the spring beam 134 along the length of the spring beam 134. The spring beam 134 includes a bend 174 between the arm 170 and the distal tip 172 along the length of the spring beam 134. The bend 174 in the illustrated embodiment is curved with a generally uniform C-shaped curve, but the bend 174 in other embodiments may have a non-uniform curve or may be angular. The spring beam 134 protrudes from the front 144 of the dielectric carrier 142 and extends in a generally frontward direction towards the front end 108 of the housing 106. The bend 174 is located at a front end 176 of the contact 116, such that the bend 174 is the front-most portion of the contact 116. For example, the bend 174 is the portion of the contact 116 most proximate to the front end 108 of the housing 106. Both the arm 170 and the distal tip 172 are disposed rearward of the bend 174. Due to the bend 174, the distal tip 172 of the spring beam 134 is not located at the front end 176 of the contact 116. The segment of the spring beam 134 extending from the bend 174 to the distal tip 172 is a bent-back segment because this segment at least partially overlaps the spring beam 134. The term "bent-back" as used herein refers only to the shape of the spring beam 134, and not to a method of manufacture. For example, the bends 174 in the spring beams 134 may be formed by physically bending a metal sheet or, alternatively, by stamping a metal sheet with a die in the shape of the contacts 116 without physically bending the sheet.

In an embodiment, the bend 174 in the spring beam 134 extends from the arm 170 inward toward the center line 132 of the card slot 112. Due to the inward bend 174, the distal tip 172 is disposed more proximate to the center line 132 than the proximity of the arm 170 to the center line 132. The spring beam 134 defines a lead-in segment 178 between the bend 174 and the distal tip 172. The lead-in segment 178 may include at least a portion of the bend 174. The lead-in segment 178 extends at least partially rearward from the front end 176 of the contact 116 and into the card slot 112. The lead-in segment 178 is configured to engage the card edge 114 of the plug connector 105 when the card edge 114 enters the card slot 112 in the rearward loading direction 113. The lead-in segment 178 allows the card edge 114 to slide relative to the spring beam 134 without mechanically stubbing. As the card edge 114 slides along the lead-in segment 178, the spring beam 134 deflects outward in a direction away from the center line 132.

In the illustrated embodiment, the arm 170 of the spring beam 134 extends generally linearly from the dielectric carrier 142 to the bend 174. The bend 174 has a curved, C-shape that extends approximately 180 degrees from the arm 170 to the distal tip 172. For example, the bend 174 extends to the distal tip 172. The lead-in segment 178 is defined along the bend 174 between the front end 176 of the contact 116 and the distal tip 172. In an alternative embodiment, the spring beam 134 may include a discrete segment extending from the bend 174 to the distal tip 172, such as a linear lead-in segment 304 shown in FIG. 7.

Figure 5:
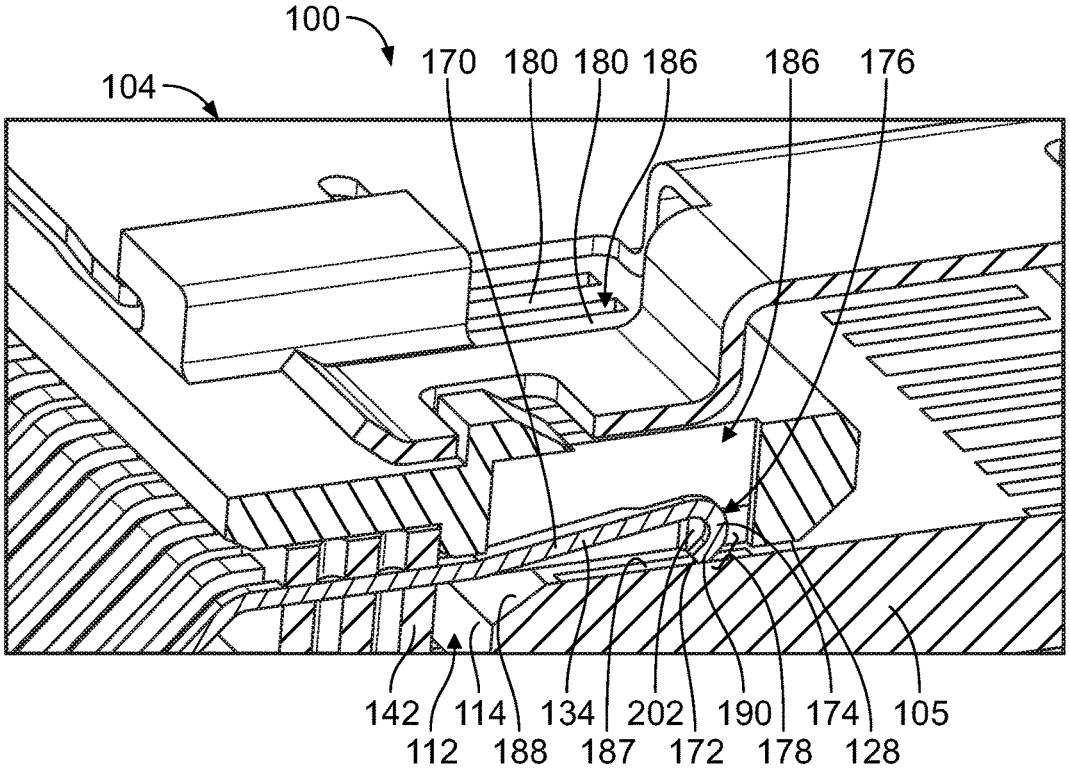
FIG. 5 is a cross-sectional view of a portion of the electrical connector system according to an embodiment showing the plug connector fully loaded within the card slot of the receptacle connector.

The housing 106 in an embodiment includes parallel separating walls 180 that define contact channels 182 therebetween. The spring beams 134 of the contacts 116 are held at least partially within the contact channels 182. Each contact channel 182 receives a corresponding spring beam 134. The separating walls 180 hold the positions of the spring beams 134 and prevent adjacent spring beams 134 from engaging each other. FIG. 4 shows one separating wall 180 and one contact channel 182 defined along the first side wall 122, but additional separating walls 180 are shown in FIG. 5. As shown in FIG. 2, the second side wall 124 (shown in FIG. 2) may also include parallel separating walls 180 and contact channels 182. The contact channels 182 are open to the card slot 112. The separating walls 180 of the first side wall 122 define at least a portion of the interior surface 128. In an embodiment, the arms 170 of the spring beams 134 are disposed generally within the contact channels 182 when the spring beams 134 are in an undeflected or resting position. Therefore, the arms 170 are recessed from the card slot 112 in the contact channels 182. The bends 174 of the spring beams 134 extend from the contact channels 182 beyond the interior surface 128 of the first side wall 122 into the card slot 112. The distal tips 172 of the spring beams 134 are disposed within the card slot 112 (not in the contact channels 182) when in the resting position shown in FIG. 4. Therefore, the distal tips 172 are exposed in the card slot 112 for engaging the plug connector 105.

In an embodiment, the contact channels 182 of the housing 106 also include relief slots 186 located vertically outward of the spring beams 134. When the spring beams 134 are in the resting position, the relief slots 186 of the first side wall 122 are vertically above the arms 170 of the spring beams 134. The relief slots 186 provide a space into which the spring beams 134 can deflect when the plug connector 105 is received in the card slot 112. The sizes of the contact channels 182 and relief slots 186 may be selected to control the impedance at the mating interface.

FIG. 5 is a cross-sectional view of a portion of the electrical connector system 100 according to an embodiment showing the plug connector 105 fully loaded within the card slot 112 of the receptacle connector 104. Only one spring beam 134 is shown in FIG. 5, but the spring beam 134 may be representative of the other spring beams 134 of the connector 104. The spring beam 134 in FIG. 5 is shown in a biased or deflected position. In the deflected position, the spring beams 134 are spring-loaded against the plug connector 105 due to an internal biasing force exerted by the spring beams 134. Spring-loading the contacts 116 maintains a mechanical and electrical connection with the plug connector 105.

As the plug connector 105 is received within the card slot 112, the plug connector 105 deflects the spring beam 134 outward away from the card slot 112. More specifically, the card edge 114 engages the lead-in segment 178. Optionally, the card edge 114 may include a ramp surface 188 that engages the lead-in segment 178 to reduce the force on the spring beam 134 and gradually deflect the spring beam 134. The spring beam 134 may bend at the arm 170, such that the arm 170 is bent or curved (e.g., no longer linear) when in the deflected position. At least a portion of the spring beam 134 proximate to the bend 174 is received into the relief slot 186.

As shown in FIG. 5, the distal tip 172 of the spring beam 134 engages a contact element 187 on the plug connector 105. The distal tip 172 defines a mating interface 190 of the contact 116 that engages and electrically connects to the plug connector 105. Therefore, the mating interface 190 of the contact 116 is located at the distal tip 172. In an alternative embodiment, the mating interface 190 may be proximate to the distal tip 172 but not at the distal tip 172. For example, the mating interface 190 may be portion of the spring beam 134 located between the distal tip 172 and the front end 176 along the length of the spring beam 134. In such an alternative embodiment, the distal tip 172 is rearward of the mating interface 190.

Since the spring beams 134 are bent back along the bends 174, the contacts 116 do not have electrical stub portions that extend from the mating interface to distal tips at the front end 176 of the contacts 116. For example, there are no cantilevered or protruding portions of the contacts 116 at the front ends 176. Since the mating interface 190 is at the distal tip 172 in FIG. 5, the electrical current transmission path extends from the distal tip 172 along the entire length of the contact 116 to the terminating end 136 (shown in FIG. 2). There is no extraneous portion of the contact 116 outside of the electrical current transmission path that extends to the distal tip 172. Since the contacts 116 lack electrical stub portions that are known to discharge electrical energy and/or reflect electrical resonance, the receptacle connector 104 may provide improved signal transmission performance over known high speed connectors.

Figure 6:
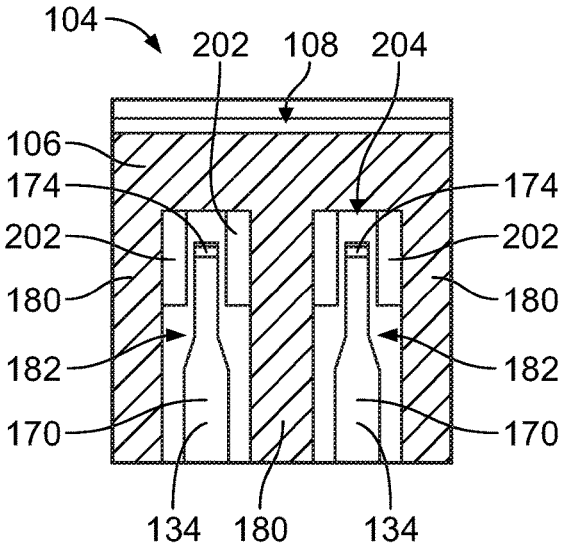
FIG. 6 is a top-down cross-sectional view of a portion of the receptacle connector according to an embodiment.

FIG. 6 is a top-down cross-sectional view of a portion of the receptacle connector 104 according to an embodiment. The portion shows the front end 108 of the housing 106 and multiple separating walls 180. The illustrated portion also shows end segments of two spring beams 134 aligned in corresponding contact channels 182 between the separating walls 180. In an embodiment, the spring beams 134 have tapered thicknesses. The spring beams 134 along the bends 174 are narrower or thinner than the segments of the arms 170 more proximate to the dielectric carrier 142 (shown in FIG. 5). The spring beams 134 may be tapered in order to reduce the electrical resistance at the mating interface and/or provide impedance matching. In an embodiment, the housing 106 includes alignment tabs 202 that extend from the separating walls 180 into the contact channels 182. The alignment tabs 202 in the illustrated embodiment are located at or proximate to the front ends 204 of the contact channels 182 and align generally with the bends 174 of the spring beams 134. For example, the alignment tabs 202 align with the narrow or thin segments of the spring beams 134. The alignment tabs 202 reduce the gap distance across the contact channels 182 between the separating walls 180. The alignment tabs 202 may be configured to block the ends of the spring beams 134 from moving laterally out of position and/or may be used for controlling the impedance at the mating interface (since the alignment tabs 202 may be composed of a dielectric material). In an embodiment, the alignment tabs 202 are located proximate to the interior surface 128 (shown in FIG. 5). The cross-section of FIG. 6 extends through the housing 106 along a plane that is above the alignment tabs 202.

Figure 7:
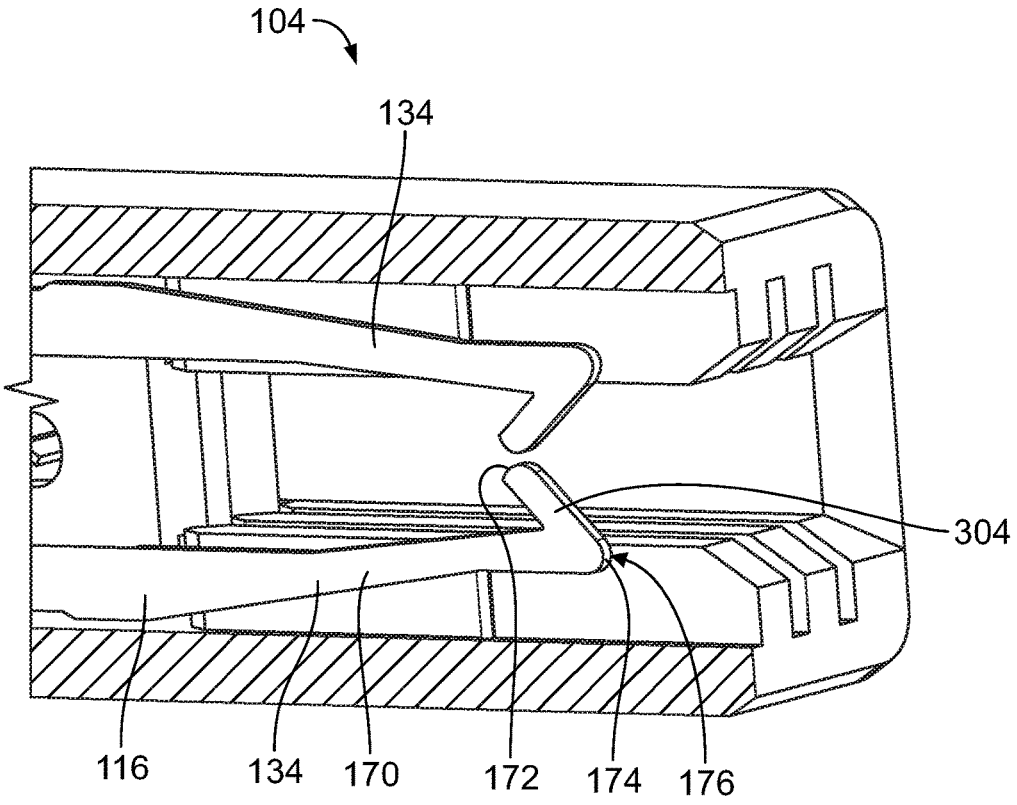
FIG. 7 is a side cross-sectional view of a portion of the receptacle connector according to an alternative embodiment.

FIG. 7 is a side cross-sectional view of a portion of the receptacle connector 104 according to an alternative embodiment. In the illustrated embodiment, the bends 174 of the spring beams 134 are angular instead of curved. For example, the bend 174 of each spring beam 134 defines a vertex at an intersection between the arm 170 and a lead-in segment 304. The lead-in segment 304 is linear and extends from the bend 174 to the distal tip 172. The bend 174 defines an acute angle between the arm 170 and the lead-in segment 304. The bend 174 is located at the front end 176 of the contact 116, and the lead-in segment 304 extends at least partially rearward, overlapping a portion of the arm 170. Similar to the spring beams 134 shown in FIGS. 4 and 5, the mating interface of each spring beam 134 that is configured to engage the plug connector 105 (shown in FIG. 5) is located at or proximate to the distal tip 172. Therefore, like the spring beams 134 shown in FIGS. 4 and 5, the spring beams 134 in FIG. 7 do not include antenna-like electrical stub portions at the distal tips 172 or at the front ends 176 of the contacts 116. Furthermore, the arms 170 in the illustrated embodiment extend frontward like the arms 170 shown in FIG. 2, but are contoured as opposed to linear. Therefore, it is recognized that the arms 170 need not extend linearly when in the resting or undeflected position.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A receptacle connector comprising:

a housing extending between a front end and an opposite, rear end, the housing defining a card slot that is open at the front end for receiving a mating plug connector into the card slot through the front end; and a plurality of contacts held in the housing, the contacts including deflectable spring beams exposed in the card slot and configured for electrical connection with the plug connector, each of the spring beams extending continuously from an arm to a distal tip, the spring beams including bends between the arms and the distal tips, the bends located at front ends of the contacts such that the distal tips and the arms of the spring beams are disposed rearward of the bends, wherein at least some of the contacts are arranged in an array and held by a dielectric carrier located rearward of the card slot, the spring beams of the at least some of the contacts protruding from a front of the dielectric carrier at least partially into the card slot.

2. The receptacle connector of claim 1, wherein the distal tips define mating interfaces that mechanically engage the plug connector when the plug connector is fully loaded within the card slot.

3. The receptacle connector of claim 1, wherein the spring beams define mating interfaces that mechanically engage the plug connector when the plug connector is fully loaded within the card slot, the mating interfaces located between the front ends of the contacts and the distal tips along the lengths of the spring beams such that the distal tips are rearward of the mating interfaces.

4. The receptacle connector of claim 1, wherein the housing includes a first side wall and a second side wall both extending to the front end of the housing, the card slot defined between interior surfaces of the first and second side walls, the card slot having a center line centered between the interior surfaces, the spring beams arranged along at least one of the first side wall or the second side wall, the bends of the spring beams extending from the arms inward towards the center line of the card slot such that the distal tips are disposed more proximate to the center line than a proximity of the arms to the center line.

5. The receptacle connector of claim 1, wherein the housing includes a first side wall that extends to the front end of the housing, the first side wall including an interior surface that at least partially defines the card slot, the first side wall defining contact channels that are open to the card slot, the arms of the spring beams disposed within the contact channels, the bends of the spring beams extending beyond the interior surface of the first side wall such that the distal tips are disposed within the card slot.

6. The receptacle connector of claim 1, wherein the bends of the spring beams are curved.

7. The receptacle connector of claim 1, wherein the bends of the spring beams are angular, each of the bends of the spring beams defining a vertex at an intersection between the arm and a lead-in segment of the spring beam, the lead-in segment extending from the vertex to the distal tip.

8. The receptacle connector of claim 1, wherein the spring beams define lead-in segments between the bends and the distal tips along the lengths of the spring beams, the lead-in segments extending at least partially rearward from the bends and at least partially into the card slot to prevent stubbing with the plug connector when the plug connector is loaded into the card slot in a rearward loading direction.

9. The receptacle connector of claim 1, wherein the housing includes separating walls that define contact channels, the spring beams of the contacts held within the contact channels, the contact channels including relief slots into which the spring beams are deflected when the plug connector is received in the card slot.

10. The receptacle connector of claim 1, wherein the contacts extend from the spring beams to terminating ends, the terminating ends configured for electrical connection with a circuit board.

11. The receptacle connector of claim 1, wherein the contacts extend continuously from the distal tips to terminating ends, the distal tips defining mating interfaces that mechanically engage the plug connector when the plug connector is fully loaded within the card slot, wherein the spring beams of the contacts lack portions between the mating interfaces and the distal tips that do not engage the plug connector.

12. The receptacle connector of claim 1, wherein the distal tips define mating interfaces that mechanically engage the plug connector when the plug connector is fully loaded within the card slot, the contacts defining electrical current transmission paths from the mating interfaces to respective terminating ends electrically connected to a circuit board, wherein the spring beams of the contacts lack portions outside of the electrical current transmission path.

13. The receptacle connector of claim 1, wherein the housing includes separating walls that define contact channels, the spring beams of the contacts held within the contact channels, the housing further including alignment tabs protruding from the separating walls into the contact channels, the alignment tabs aligning generally with the bends of the spring beams.

14. A receptacle connector comprising:

a housing extending between a front end and an opposite, rear end, the housing defining a card slot that is open at the front end for receiving a mating plug connector into the card slot through the front end, wherein the housing includes separating walls that define contact channels, the housing further including alignment tabs protruding from the separating walls into the contact channels; and a plurality of contacts held in the housing, the contacts including deflectable spring beams held within the contact channels, the spring beams exposed in the card slot and configured for electrical connection with the plug connector, each of the spring beams extending continuously from an arm to a distal tip, the spring beams including bends between the arms and the distal tips, the bends located at front ends of the contacts such that the distal tips and the arms of the spring beams are disposed rearward of the bends, wherein the bends of the spring beams align generally with the alignment tabs of the housing.

15. The receptacle connector of claim 14, wherein the distal tips define distal ends of the spring beams along lengths of the spring beams, the distal ends mechanically engaging the plug connector when the plug connector is fully loaded within the card slot.

16. A receptacle connector comprising:

a housing extending between a front end and an opposite, rear end, the housing defining a card slot that is open at the front end for receiving a mating plug connector into the card slot through the front end; and a plurality of contacts held in the housing, the contacts including deflectable spring beams exposed in the card slot and configured for electrical connection with the plug connector, each of the spring beams extending continuously from an arm to a distal tip, the spring beams including bends between the arms and the distal tips, the bends of the spring beams located at front ends of the contact such that the distal tips and the arms of the spring beams are disposed rearward of the bends, wherein the distal tips define distal ends of the spring beams along lengths of the spring beams, the distal ends mechanically engaging the plug connector when the plug connector is fully loaded within the card slot.

17. The receptacle connector of claim 16, wherein the housing has first and second side walls that define contact channels that are open to the card slot, the arms of the spring beams disposed within the contact channels, the contact channels including relief slots into which the arms of the spring beams are deflected when the plug connector is received in the card slot.

18. The receptacle connector of claim 16, wherein the housing has first and second side walls that define contact channels that are open to the card slot, the arms of the spring beams disposed within the contact channels, the bends of the spring beams extending beyond respective interior surfaces of the corresponding first and side walls such that the distal tips are disposed within the card slot.

19. The receptacle connector of claim 16, wherein the housing includes separating walls that define contact channels, the spring beams of the contacts held within the contact channels, the housing further including alignment tabs protruding from the separating walls into the contact channels, the alignment tabs aligning generally with the bends of the spring beams.

20. The receptacle connector of claim 16, wherein at least some of the contacts are arranged in an array and held by a dielectric carrier located rearward of the card slot, the spring beams of the at least some of the contacts protruding from a front of the dielectric carrier at least partially into the card slot.

* * * * *